United States Patent [19]

Scott

[11] 4,193,500

[45] Mar. 18, 1980

[54] BY-PASS DOOR ASSEMBLY

[75] Inventor: Victor J. Scott, Spring Lake, Mich.

[73] Assignee: Leigh Products, Inc., Coopersville, Mich.

[21] Appl. No.: 882,595

[22] Filed: Mar. 2, 1978

Related U.S. Application Data

[62] Division of Ser. No. 764,344, Jan. 31, 1977, Pat. No. 4,123,874.

[51] Int. Cl.[2] ..... B65D 69/00; B65D 71/00

[52] U.S. Cl. ..... 206/577; 49/411; 49/425; 52/720; 52/823; 206/321

[58] Field of Search ..... 206/577, 321; 49/411, 49/410, 425, 501; 52/716–718, 720, 721, 821, 823, 824

[56] References Cited

U.S. PATENT DOCUMENTS

| | | | |
|---|---|---|---|
| 25,413 | 4/1896 | Jones | 52/720 X |
| 25,414 | 4/1896 | Jones | 52/720 X |
| 2,798,262 | 7/1957 | Beamer | 52/823 |
| 2,848,735 | 8/1958 | Ault et al. . | |
| 2,981,579 | 4/1961 | Shwayder et al. . | |
| 3,001,246 | 9/1961 | Mather | 52/823 |
| 3,058,173 | 10/1962 | Brydolf | 49/411 |
| 3,261,129 | 7/1966 | Brydolf et al. | 49/411 |
| 3,294,353 | 12/1966 | Rowe | 52/823 X |
| 3,382,614 | 5/1968 | Adell | 52/823 |
| 3,382,615 | 5/1968 | Adell | 52/823 |
| 3,450,426 | 6/1969 | Kellems | 52/826 X |
| 3,562,956 | 2/1971 | Johnson, Jr. | 49/411 |
| 3,650,071 | 3/1972 | Tanner | 49/411 |
| 3,683,451 | 8/1972 | Tanner | 49/410 X |
| 3,701,179 | 10/1972 | Cox | 49/411 X |
| 3,744,827 | 7/1973 | Cox | 49/411 X |
| 3,750,337 | 8/1973 | Brydolf et al. | 49/411 |
| 3,766,700 | 10/1973 | Nuss | 52/717 X |
| 3,838,548 | 10/1974 | Tanner | 52/823 X |
| 3,879,912 | 4/1975 | Cox | 49/411 X |

FOREIGN PATENT DOCUMENTS 191604 9/1957 Fed. Rep. of Germany .

*Primary Examiner*—Philip C. Kannan

*Attorney, Agent, or Firm*—Price, Heneveld, Huizenga & Cooper

[57] ABSTRACT

A by-pass door assembly is disclosed including a pair of stiles and a pair of trim pieces adapted to frame a rectangular panel and a plurality of corner brackets held by the stiles and the trim pieces. Each of the stiles includes an elongated one-piece slot free member having spaced front and rear walls joined by a side wall to define a panel receiving channel. The rear wall and the side wall define a triangular box shaped portion. Each of the trim pieces includes a rear wall having a longitudinally extending, outwardly directed groove portion. Each of the corner brackets includes a central, channel-shaped housing and outwardly extending portions having spaced tabs adapted to be received and captured by the stile members. Tabs extend outwardly from the transverse edge of the bracket and include a transverse bead which is captured by the groove of the trim member. Brackets on one side of the panel are adapted to retain guide rollers to either suspend the door construction from an upper track or to support the door construction on the lower track. The remaining corner brackets carry guide members having flexible attachment tabs.

4 Claims, 15 Drawing Figures

BY-PASS DOOR ASSEMBLY

This is a division of application, Ser. No. 764,344, filed Jan. 31, 1977 now U.S. Pat. No. 4,123,874.

BACKGROUND OF THE INVENTION

This invention relates to door closures and more particularly to hardware for a by-pass type sliding door construction.

Various forms of sliding door or by-pass door constructions have been proposed. These doors include a pair of rectangular panels which are mounted in a doorway for sliding movement relative to each other. The hardware for such by-pass doors typically upper and lower trim members and side stile members, each of the members being adapted to receive an edge of the rigid panel to thereby frame the panel. Corner brackets, either by fasteners or by slots and connecting lugs or tang arrangements, are connected to the trim and stile members. The corner brackets help in rigidifying the door construction and connect the stiles and trim members. In a typical top roller by-pass door, the upper corner brackets will carry screw adjustable roller assemblies. The roller assemblies include rollers which ride within an upper track secured to the door header. The lower brackets carry guide members which are adapted to ride within a lower track so as to guide the doors and to prevent inadvertent removal of the doors from the tracks.

When the rectangular panel framed by the stile and trim members is of a relatively heavy construction such as when the rectangular panel is a mirrored panel, bottom roller configurations are preferred since they are better able to support the increased weight. For these latter arrangements, the positioning of the rollers and the guides is usually reversed.

Examples of such previous by-pass or sliding door constructions may be found in U.S. Pat. No. 3,879,912, entitled HARDWARE FOR A SLIDING DOOR INSTALLATION, issued Apr. 29, 1975, to Cox; U.S. Pat. No. 3,750,337, entitled SLIDING DOOR CORNER CONNECTOR, issued Aug. 7, 1973 to Brydolf et al; U.S. Pat. No. 3,650,071, entitled PANEL FRAME ASSEMBLY, issued Mar. 21, 1972 to Tanner; U.S. Pat. No. 3,562,956, entitled SLIDING DOOR FRAME, issued Feb. 16, 1971 to Johnson, Jr.; and U.S. Pat. No. 3,261,129, entitled PANEL HARDWARE, issued July 19, 1966 to Brydolf et al.

The prior art arrangements exemplified by these aforementioned patents typically employ fasteners to secure the stiles, the trim members and the corner brackets to each other and to the panels, or in the alternative, they employ slots and cooperating lugs or tangs on the brackets and/or stile or trim members to interconnect the sliding door hardware. The constructions noted above employing lugs and slots present difficulty in adapting the hardware to doors of varying sizes. Individuals installing doors of this type by themselves without the help of professional installers have problems adapting the doors and installing them in nonstandard openings. The particular size door opening may not be dimensioned in accordance with the standard stile and trim member dimensions offered by a manufacturer. In such instances, snap together sliding door hardware employing slots and lug or tab interconnections must be reworked with new slots formed in the members. Such reworking is not always easily accomplished and requires special tools normally not available to the installer, particularly the do-it-yourself installer.

It is highly desirable for the sliding door hardware to readily adapt to and frame panels of varying thickness. The sliding door installations should be readily and easily adjusted between the upper and lower tracks to insure proper operation without the need for using hand tools. The stile and trim members besides serving to frame the panel and support the corner brackets should also substantially increase the rigidity of the panel and overall door construction from that provided by the panel alone.

A need exists for a by-pass door assembly employing completely snap together hardware readily modified for doors of smaller dimension than that provided by the standard size stile and trim members, which is easily manufactured, which is aesthetically pleasing and which is readily and easily adjusted for proper operation without the use of hand tools.

SUMMARY OF THE INVENTION

In accordance with the present invention, improved stiles, trim pieces, corner brackets, rollers and guide members are provided by which the problems heretofore experienced are substantially alleviated. Essentially, the stiles which frame the vertical edges of a central panel are fabricated as elongated members each defining a panel receiving channel and including a front wall, a side wall and a rear wall. The front wall includes a reverse bent portion terminating in a sharp edge positioned within the channel. The rear wall and the side wall define a triangular box portion which substantially increases the rigidity of the stile and reduces the amount of material necessary for such a rigid stile construction. The rear wall of the stile also includes a reverse bent portion angled towards the front wall and the side wall. The stile channel is adapted to receive a wide range of panel sizes while preventing cocking or twisting of the stile on the panel during installation.

Each of the corner brackets are non-handed and includes a central channel-shaped housing portion having a longitudinal slot therein for adjustably receiving a roller or a guide means. The brackets include outwardly extending portions having tabs thereon which are received under the reverse bent portions of the rear walls of the stiles. Extending from a transverse edge of the bracket is an L-shaped member having a bead therein. The bead is adapted to cooperate with the corresponding, longitudinally extending groove formed in the trim members. The trim members snap over the L-shaped lugs and capture the bead within the grooves.

The stiles and trim members are slot free and do not require fasteners for securement. The members are readily adapted to odd-size doors by merely straight cutting the members to the proper dimension. Provision is made for attaching the guides to the brackets so that they may be removed from the brackets once the door is installed for replacement without disassembly of the door.

DETAILED DESCRIPTION OF THE PREFERRED EMBODIMENT

Figure 1:
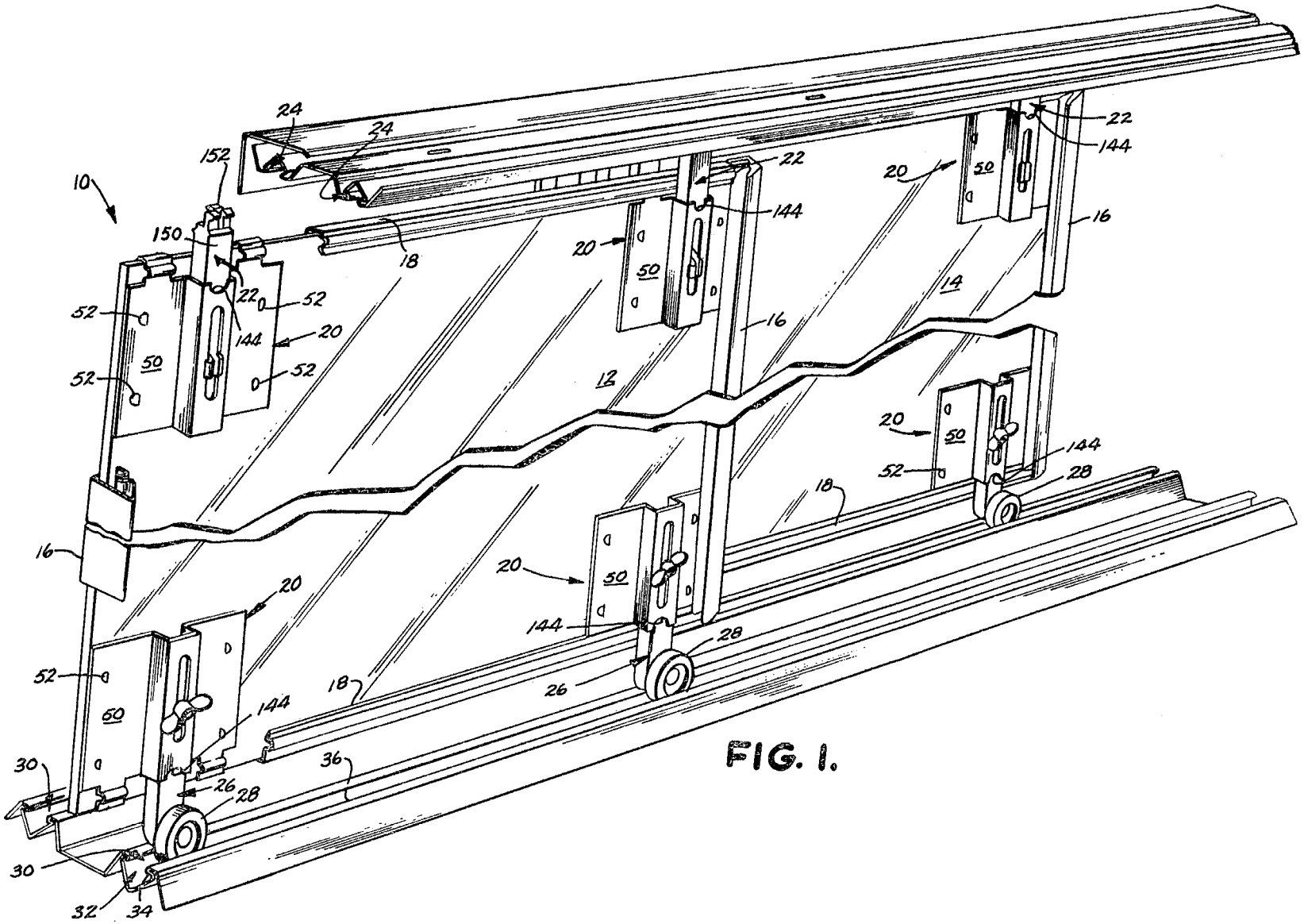
FIG. 1 is a fragmentary, partially sectioned, perspective view of a bottom roller by-pass door assembly in accordance with the present invention.
Figure 2:
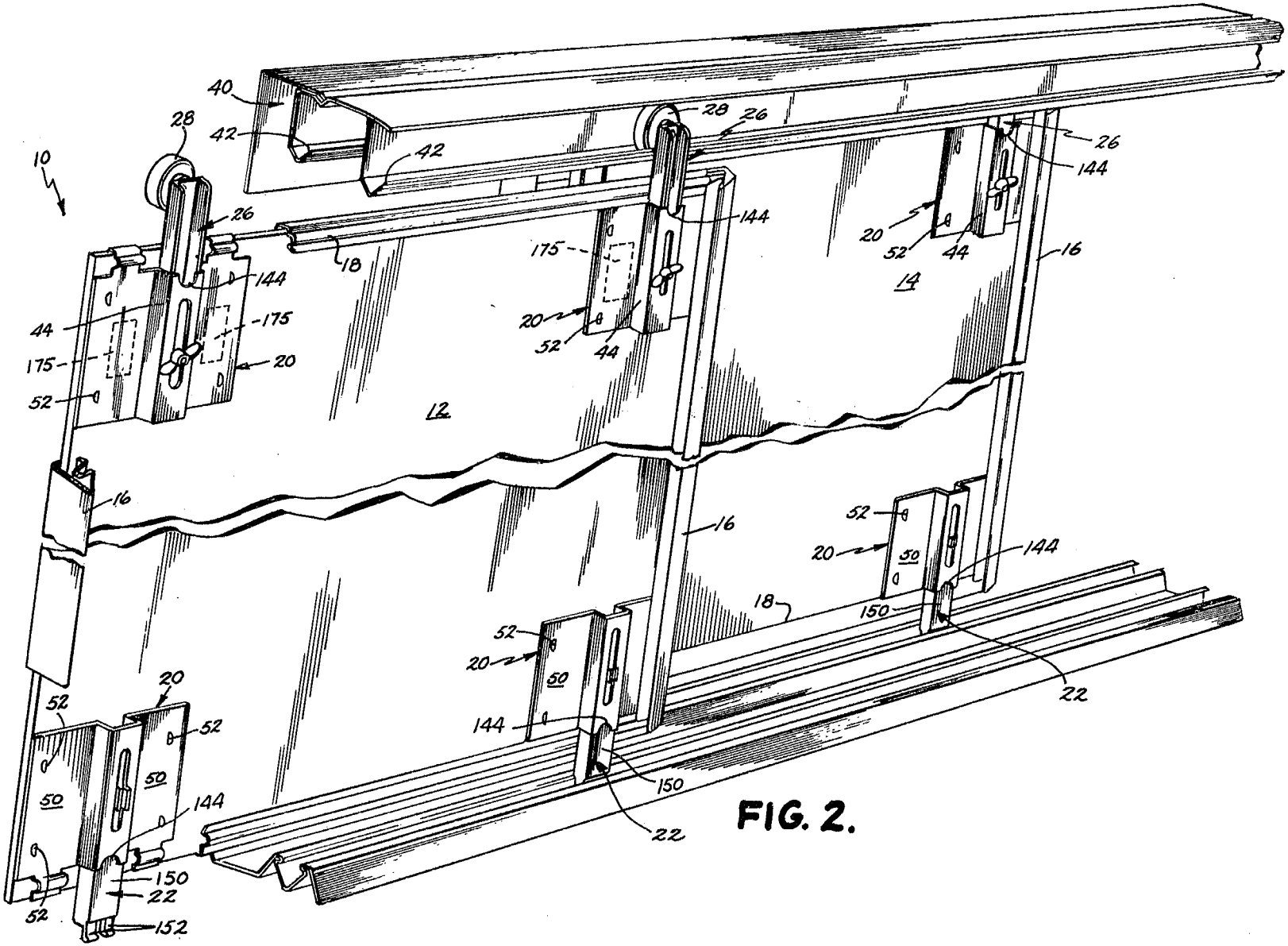
FIG. 2 is a fragmentary, partially sectioned, perspective view of a top roller by-pass door assembly in accordance with the present invention.

A bottom roller, by-pass door assembly including hardware in accordance with the present invention is illustrated in FIG. 1 and generally designated 10. A top roller, by-pass door assembly incorporating hardware in accordance with the present invention is illustrated in FIG. 2 and generally designated 10'. Each of the sliding or by-pass door assemblies 10 and 10' include a pair of rectangular panels 12, 14, stiles 16, trim pieces 18 and corner brackets 20. In the bottom roller configuration illustrated in FIG. 1, the upper corner brackets 20 carry guide members 22 adapted to snap fit and ride within trackways 24 secured to the header of a door. The bottom corner brackets 20 in the embodiment illustrated in FIG. 1 adjustably carry roller assemblies 26. The roller assemblies 26 include rollers 28 which ride in lower trackways 30 positioned at the threshold of the door opening. With the bottom roller configuration, the upper trackways 24 and the lower trackways 30 are identical. The trackways are fabricated from a single sheet of material as by roll forming or from bulk material as by extrusion and include a generally V-shaped channel 32 having shoulders 34 which define a mouth 36 through which the rollers 28 or the guides 22 extend.

The top roller or hung configuration, illustrated in FIG. 2, includes the same stile members 16, trim pieces 18, corner brackets 20, guides 22 and roller assemblies 26. However, the roller assemblies 26 are reversed from their orientation illustrated in FIG. 1 and the upper trackway 24 of FIG. 1 is replaced by a roller trackway 40 defining a pair of parallel, spaced roller tracks 42 adapted to receive the rollers 28. The lower trackway of the embodiment of FIG. 2 is the same as that in FIG. 1 and the guides 22 are adapted to ride within the channel 32 of the trackway to thereby guide the individual doors in their sliding motion.

Each of the corner brackets 20, as best seen in FIG. 1, 2, 7, 9 and 15 is identical in configuration and is non-handed. Each of the brackets 20 includes a bracket plate having a central, channel-shaped housing 42. The channel-shaped housing 42 includes side walls 44 and a top wall 46 having a longitudinal, adjustment slot 48 formed therein. Extending outwardly from the lateral edges of the central housing 42 are a pair of wing members or securing means 50. Each of the wing members 50 includes spaced, semicircular, lanced tabs 52 adjacent the lateral edges thereof. The spaced tabs 52 are formed by a simple lancing operation and are adapted to secure the corner brackets to the stile members, as more fully explained below. Extending from a transverse edge of each bracket are a pair of L-shaped tabs 54. The free leg 56 of the tab 54 engages the transverse edge of the panel 12, as seen in FIGS. 1 and 2, to position the bracket on the panel prior to snap on attachment of the trim pieces. The non-free leg 58 of the tab 54 includes a transverse bead 60. The transverse bead 60 is adapted to cooperate with the trim piece to secure the corner bracket to the panel, as more fully described below.

Figure 3:
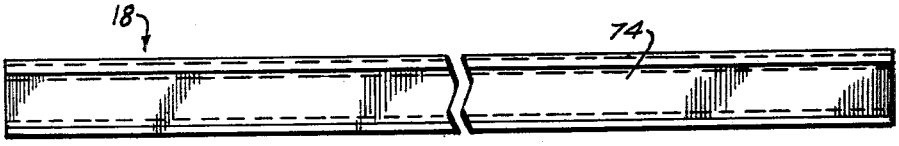
FIG. 3 is a fragmentary, top plan view of a trim member in accordance with the present invention.
Figure 4:
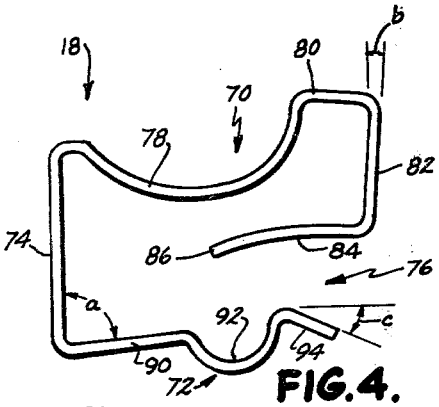
FIG. 4 is an enlarged, end view of the trim member of FIG. 3.

The trim pieces 18 are best seen in FIGS. 3 and 4. As shown therein, each trim piece is fabricated as an elongated, generally channel-shaped member. The trim piece 18 includes a front wall 70, a rear wall 72 and a base wall 74. The walls define a channel 76 adapted to receive panel sections of varying thickness. The front wall 70 includes a generally curved portion 78, a first planar portion 80, a second planar portion 82 directed towards the channel 76 and angled slightly towards the base wall 74, a rear wall 72 and a reverse bent portion 84 which extends into the channel 76. The portion 84 has a generally curved shape in cross section and terminates in a sharp edge 86 which is positioned within the channel. The rear wall 72 includes a first planar portion 90 which joins the base wall 74 at an angle a, a longitudinal groove or semi-circular portion 92 and a second planar portion 94. The second planar portion 94 is angled with respect to the horizontal at an angle c. The second planar portion 82 of the front wall, which in conjunction with the curved portion 84 defines a reverse bent portion, is angled with respect to vertical at angle b. The curved portion 84 of the front wall 70 and the rear wall 72 define the mouth of the channel 76. The trim piece is fabricated from a somewhat resilient material such as cold rolled steel and will flex to receive panels of varying thickness. In one existing embodiment, the angle a is equal to 84°, the angle b is equal to 5° and the angle c is equal to 24°. The semi-circular groove 92 of the trim piece, as best seen in FIGS. 1 and 2, snaps over the L-shaped lugs 54 of the corner bracket 20. The bead 60 is captured within the groove 92. In this manner, the trim piece and the brackets are interconnected. Further, the sharp edge 86 of the front wall portion 84 will dig into the panel material when the trim member is snapped over the edge of the panel to thereby resist separation of the trim piece from the panel.

Figure 5:
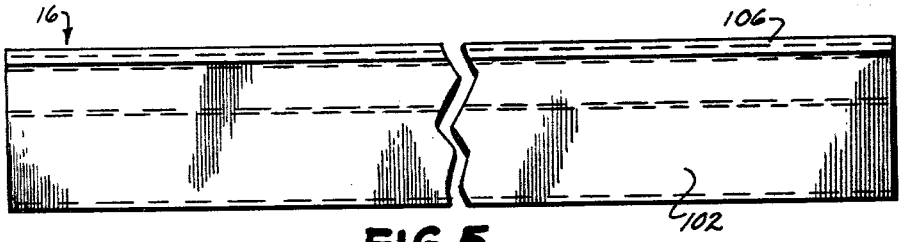
FIG. 5 is a side, elevational view of a stile member in accordance with the present invention.
Figure 6:
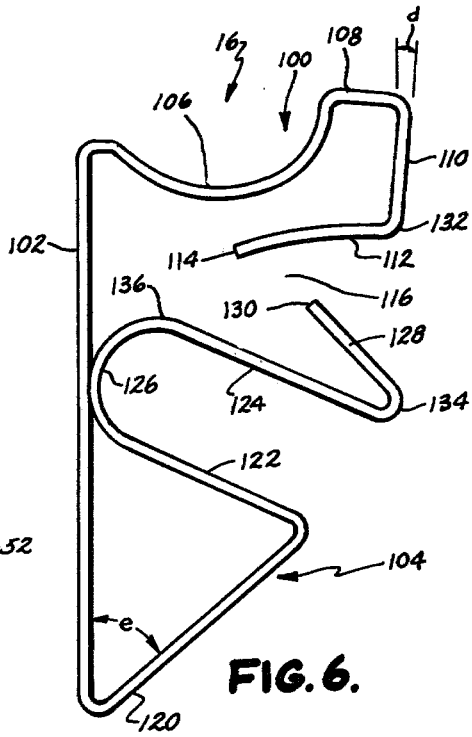
FIG. 6 is an enlarged, end view of the stile member of FIG. 5.

The stile 16 is best seen in FIGS. 5 and 6. As shown therein, the stile is also fabricated from a single piece of material as an elongated member and includes a front wall 100, a side wall 102 and a rear wall 104. The front wall 100 has a curved portion 106, a first planar portion 108, a second planar portion 110 extending towards the rear wall 104 and slightly towards the side wall 102. A generally curved portion 112 extends towards the side wall 102, joins the second planar portion 110 in a generally perpendicular fashion and terminates in a sharp edge 114 which is positioned within the channel 116 of the stile member. The portions 110 and 112 define a generally Lshaped, reverse bent portion.

The front wall 70 of the trim piece and the front wall 100 of the stile member, although dimensioned differently, are provided with the same styling. As a result, the trim piece and the stile member will frame the panel in an aesthetically pleasing fashion. Further, the curved portion 106 and the planar portions 108 and 110 of the front wall define an integral pull handle. This design, therefore, eliminates the need for separate handles which would have to be attached to the panels 12 or 14.

The rear wall 104 is configured to substantially increase the rigidity of the stile and hence the rigidity of the framed panel with a minimum amount of material. Also, the rear wall is configured so that the stile may be easily snapped on the edge of the panel without cocking or camming relative to the panel. As best seen in FIG. 6, the rear wall 104 includes a first planar portion 120 which is integral with the lateral edge of the side wall 102 and defines an angle e with the side wall 102. A second planar portion 122 integral with the opposite end of the first portion 120 extends towards the side wall 102. As a result, the first portion 120 and the second portion 122 define, with the side wall 102, a generally triangular shaped box portion in cross section. This triangular shaped portion increases the rigidity of the stile. As a result, thinner panels may be used in the door assembly. This reduces manufacturing and installation costs from present values while still providing a rigid door. The second portion 122 joins with a third portion 124 through a curved portion 126 which contacts the inner surface of the side wall 102. As a result, the portions 122, 124 and 126 define an elongated, generally U-shaped groove, the base of which contacts the inner surface of the side wall 102. The rear wall 104 terminates in a reversely bent, planar portion 128 which extends towards the front wall 100 and the side wall 102. The reversely bent portion 128 also terminates in a sharp edge 130 which is positioned within the channel 116. The curved portion 106 of the front wall 100 and the curved portion 126 of the rear wall 104 increase the flexibility of the front and rear walls so that the stile member will accommodate a fairly wide range of panel thicknesses.

When the stile is snapped over the edge of the panel, the reversely bent portion 128 of the rear wall 104 will flex and snap over the lanced tabs 52 at the lateral edges of each corner bracket 20. In this manner, the brackets 20 are captured and retained by the stile members 16. A stile fabricated in accordance with the present invention is capable of accommodating a wider range of panel thicknesses than that heretofore possible. The triangular box-like structure defined by the rear wall and a side wall gives strength and rigidity to the stile and the resulting panel construction. The sharp edge 114 and the edge 130 of the front and rear wall, respectively, will tend to dig into the panel once it is installed within the channel 116 and thereby prevent separation of the stile from the panel.

When the stile member is snapped onto a panel edge, the panel will be contacted by the integral lateral edge of the portion 112 of the front wall which also defines the lateral edge of the mouth of the channel 116. Also the panel will be engaged by the sharp edges 114, 130, by the curved portion 126 of the rear wall and will abut the inner surface of the side wall 102. The stile therefore, in effect, provides a five-point bearing on the panel which prevents the assembler from getting the stile cocked or twisted with respect to the panel.

The throat of the channel 116 is defined by the lateral edge 132 of the portion 112 and also by the lateral edge 134 of the reversely bent portion 128 of the rear wall 104. The throat therefore gradually decreases in dimension from the mouth of the channel towards the rear wall. This structure guides the stile member onto the panel. In the preferred embodiment, the horizontal distance between the sharp edge 114 and the sharp edge 130 is equal to the horizontal distance between the sharp edge 130 and the lateral edge 132 of the front wall. In other words, the sharp edge 130 of the planar portion 128 of the rear wall terminates spaced from the portion 112 of the front wall and intermediate the lateral edges of the portion 112 of the front wall and generally opposite the longitudinal center line of the front wall reverse bent portion. The horizontal distance from a longitudinal contact line 136 on the curved portion 126 which engages the panel and the sharp edge 114 equals the horizontal distance between the sharp edge 114 and the sharp edge 130. This configuration and dimensioning insures that the stile will be snapped on without cocking or twisting. In an existing embodiment, the angle e between the first planar portion 120 of the rear wall and the side wall 102 is approximately 50°. The angle d which the second planar portion 110 of the front wall assumes with respect to vertical is approximately 5°. Panels having a thickness of $\frac{1}{8}$ inch to $\frac{1}{4}$ inch may be accommodated.

Both the trim piece and the stile are slot free pieces. Due to this fact and due to the manner by which the trim pieces and the stile capture a corner bracket, these members are readily adapted to frame panels for doors of odd sizes. All that need be done is to straight cut the trim member and the stile member to size. This eliminates the need for any special tools which have heretofore been required to accommodate odd size doors. Anyone who possesses a hacksaw has the ability to fabricate any size by-pass door. The pieces for framing the panel and the corner brackets are completely nonhanded. This fact makes the hardware easier to assemble, reduces manufacturer's costs, and increases productivity. It also reduces the possibility of miscutting or misassembling.

Figure 7:
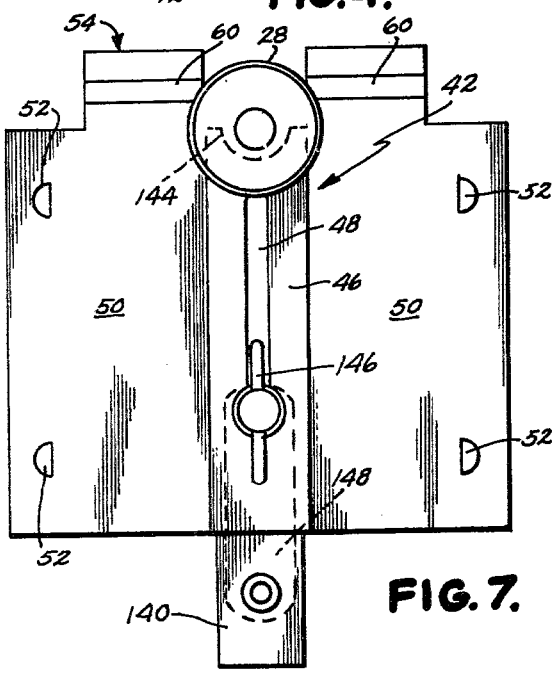
FIG. 7 is a plan view of a corner bracket including a support roller in accordance with the present invention.
Figure 8:
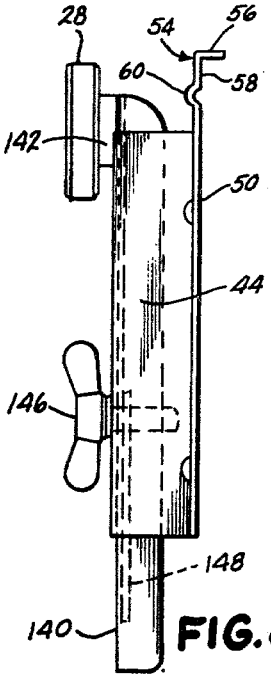
FIG. 8 is a side, elevational view of the bracket and support roller of FIG. 7.

As best seen in FIGS. 7 and 8, each roller assembly includes an elongated, rectangular arm 140 supporting an axle 142 at one end thereof. Rotatably mounted on the axle 142 is a roller 28. The housing 46 at the transverse edge from which the arm 140 extends is notched to assume a semicircular shape 144. As a result of this notching, the arm 140 may be moved into the housing so that the axle 142 abuts notch 144 to better protect the roller during shipment. The arm is adjustably secured within the slot 48 by a wing nut 146 threadably engaging a weld nut 148 secured to the arm 140. As a result of this arrangement, the door may be adjusted in the track merely by turning the wing nut 146 by hand and sliding the arm 140 relative to the longitudinal slot 48 until the proper position is obtained. As is apparent, from a comparison of FIGS. 1 and 2, when a bottom roller configuration is employed, the roller is reversed from the position assumed when a top roller configuration is employed as in FIG. 2.

As seen in FIGS. 9–14, the guide 22 includes an elongated, generally rectangular guide body 150. Extending from one end of the guide body 150 are a plurality of guide elements 152. Two of the guide elements 152 extend outwardly from the end of the guide body adjacent one surface thereof while the third guide element 152 extends from the end of the guide body adjacent the other surface thereof. The guide elements are all generally parallel to each other and to the upper and lower surfaces of the guide body 150. Each guide element is provided with a barbed head 154. The guide elements and the barbed head 154 are dimensioned so that they will snap fit into the trackways 24 or 30 and the barbed heads will engage the undersurface of the shoulders 34 of the trackway. Since the guide elements are spaced transversely of the guide body and hence longitudinally of the trackway, they will guide the door during sliding motion and also prevent inadvertent removal or untracking of the door from the trackway.

Figure 11:
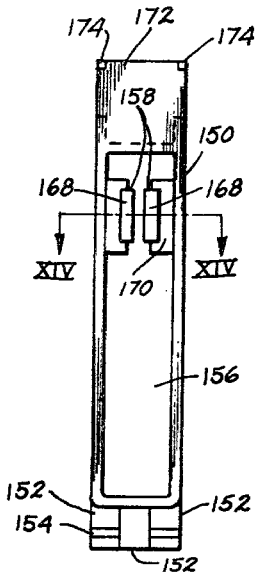
FIG. 11 is a plan view of a guide in accordance with the present invention.
Figure 12:
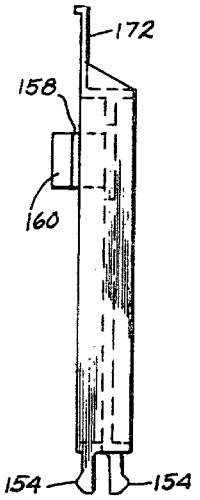
FIG. 12 is a side view of the guide of FIG. 11.
Figure 13:
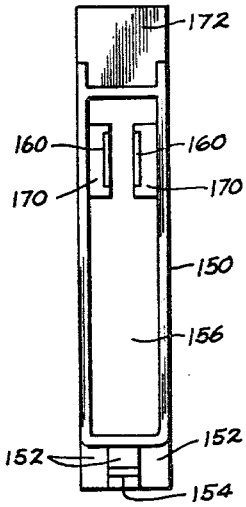
FIG. 13 is a bottom, plan view of the guide of FIG. 11.
Figure 15:
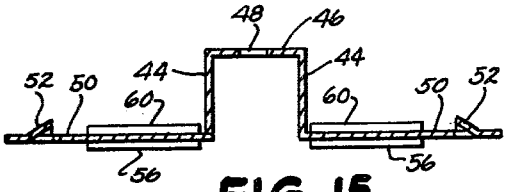
FIG. 15 is a cross-sectional view with the guide removed taken along line XV—XV of FIG. 9.
Figure 14:
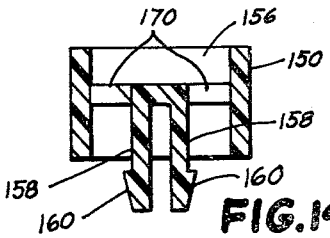
FIG. 14 is a cross-sectional view taken along line XIV—XIV of FIG. 11.

In the preferred embodiment, the guide body is molded as a one-piece, integral member in a simple, two piece mold. The guide body includes a central web 156. Extending upwardly from one face of the central web 516 are a pair of attachment and securing tabs or lugs 158. The lugs 158 are parallel to each other and also to the lateral sides of the guide body. Each attachment lug includes barbs 160 which extend outwardly towards the lateral edges of the guide body. As seen in FIGS. 11 and 13, the central web 156 defines rectangular apertures 170. These result from the use of a simple two-piece mold which permits forming of the barbed heads without the use of cams in the molding process. The guides are preferably fabricated from a plastic material, such as acetal.

Figure 10:
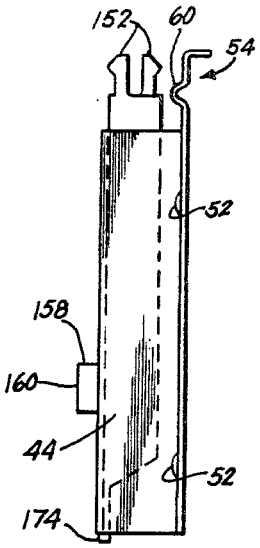
FIG. 10 is a side, elevational view of the corner bracket and guide of FIG. 9.
Figure 9:
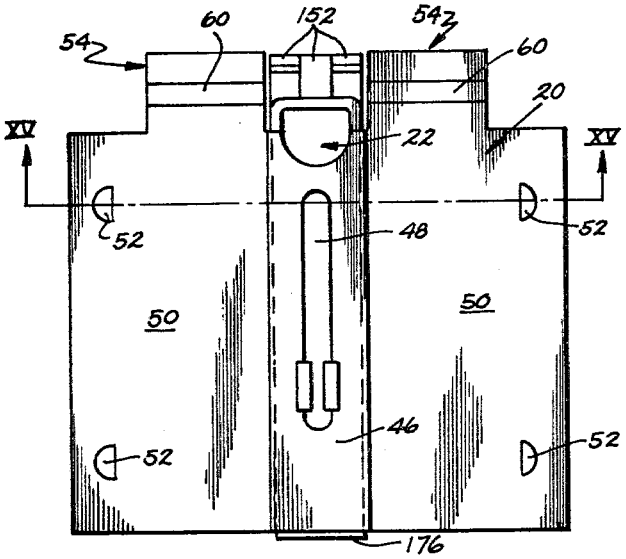
FIG. 9 is a plan view of a corner bracket including a guide member in accordance with the present invention.

Extending from the end of the guide body 150 opposite the guide elements 152 is a cantilevered, planar or tab-like portion 172. Upwardly directed teats 174 are formed at the corners of the tab 172. The guide is secured to a corner bracket 20 by snapping the attachment lugs 158 upwardly through the longitudinal slot 48. The barbs 160 engage the top surface of the central housing and frictionally retain the guide in the housing. As seen in FIGS. 9 and 10, the guide may be slipped within the housing so as to be protected by the bracket during shipment. When in the stored, shipping position, the teats 174 engage the transverse edge 176 of the housing. When the guide is slipped forward to an operating position, the teats 174 on the cantilevered tab 172 will engage the undersurface of the top wall 46 of the housing. The teats are dimensioned to reduce any warble of the guide by biasing the barbs 160 against the top surface of the housing. In this manner, the guide is fairly securely retained within the bracket structure. The attachment lugs 158 permit ready removal of the guide from the bracket without dismounting of the door structure. By squeezing the flexible lugs 158 together they may be pushed inwardly through the slot 48 permitting removal of the guide body from the bracket. This feature substantially increases the ease of replacement of guide elements as well as increasing the ease of assembly of the overall door construction.

ASSEMBLY

In order to assemble a by-pass door as a bottom roller configuration as illustrated in FIG. 1, the guide tracks 24 and 30 are attached to the header and the door threshhold, respectively. Next, the stiles are snapped onto the lateral edges of the panel. The corner brackets 20 are then positioned at the corners of the panel and the lanced tabs 52 are snapped under the edges of the stiles. Next, the trim pieces are snapped on the transverse edges of the panel and over the beaded L-shaped tabs or lugs of the bracket members. The rollers 26 are then inserted in the bottom brackets and the top guides 22 are inserted in the top brackets. In the alternative, the rollers and guides may be installed in the brackets at the point of manufacture. The panel is then positioned in the doorway and the rollers 28 are placed in their respective tracks 30. Next, the guide bodies 150 are pushed upwardly until the guide elements 152 snap into the tracks 24. The wing nuts 146 are then loosened and the roller arm 140 adjusted until the panel is centered in the doorway and plumbed against the door jamb. The bottom roller configuration eliminates the need for a substantial header or trackway which is required for the top roller configuration. This presents a much lower trackway silhouette and much more aesthetically pleasing appearance for the door closure. A fascia 180 may be sandwiched between the top trackway and the door header for aesthetic purposes. However, since in the bottom roller configuration the top and bottom trackways are the same, the fascia may be eliminated.

In the top roller configuration illustrated in FIG. 2, assembly is basically the same except that the top roller trackway 40 is secured to the header of the opening and a fasica 180 is sandwiched between the trackway 40 and the door header.

In the top roller configuration, double coated adhesive tape (FIG. 2) is placed on the back of the brackets. The adhesive tape assists in holding the corner brackets to the panel. The adhesive tape 175 (FIG. 2) prevents slipping of the brackets which must suspend the entire weight of the panel from the upper trackway. When the door is assembled in the bottom roller configuration, the adhesive backing is not required since the free legs 56 of the L-shaped tabs 54 on the brackets bear against the transverse edge of the panel to thereby support the weight. The guides do not support any of the weight of the door.

It can therefore be seen that the unique by-pass door in accordance with the present invention is a totally snap together assembly which is readily adapted to odd door sizes. The triangular box-like structure of the stiles results in a high pressure being exerted on the edge of the panels, rigidifies the structure and also captures the snap on hardware. The overall door may be lighter in weight than that heretofore available. The slide arm for each roller assembly is easily reversed for either top hanging or bottom rolling of the door and in the bottom roller configuration heavy duty operation is provided in that the weight of the door rests on the floor instead of being suspended from a header type track. Door height adjustment may be made by hand and no special tools are required. The guides and the rollers may initially be set behind the edge of the brackets to prevent damage in transport which also reduces the packaging requirements. The rollers and guides are easily replaceable without tools and without removing the door from the opening. The stiles, trim pieces, corner brackets, rollers, guides and upper and lower trackways may be packaged and sold as a kit. The purchaser selects the type and size of rectangular panel to suit his particular needs for use with the kit hardware.

In viewing of the foregoing description, those of ordinary skill in the art will probably envision certain modifications which would not depart from the concepts disclosed herein. For example, the guides could be fabricated with only a pair of guide elements extending from the end thereof. Whether two or three elements are employed is basically the result of the type of mold used in fabrication. As expressly intended, therefore, the above description should be considered as that of the preferred embodiments only. The true spirit and scope of the present invention will be determined by reference to the appended claims.

The embodiments of the invention in which an exclusive property or privilege is claimed are defined as follows:

1. A kit usable with a rectangular panel to form a sliding door closure, said kit comprising:

an upper trackway securable to the header of a door opening;

a lower trackway securable to the threshhold of a door opening;

a pair of stiles, each adapted to snap fit over a lateral edge of the rectangular panel, said stiles each being an elongated, slot free member having spaced front and rear walls joined by a side wall to define a panel receiving channel, said rear wall including a first portion angled with respect to said side wall towards said front wall, a second portion angled with respect to said first portion towards said side wall, a curved portion integral with said second portion and engaging the inner surface of said side wall, a third portion integral with said curved portion and angled away from said side wall and parallel to said second portion, and a fourth reverse bent portion angled towards said front wall and said side wall and terminating in a sharp edge disposed within said channel;

a pair of trim pieces, each adapted to snap fit over a transverse edge of said panel to frame said panel in conjunction with said stiles, said trim pieces each being an elongated slot free member having spaced front and rear walls joined by a base wall to define a channel, said rear wall defining an elongated, semi-circular groove;

a plurality of corner brackets, each corner bracket including a central housing and outwardly extending wings, said wings each including tabs positioned so that said bracket is securable to said stiles and said panel by snapping said tabs under said stile rear wall reverse bent portion, said brackets further including an L-shaped tab extending from a transverse edge of one of said wing members, said tab defining a semi-circular bead, said trim member snapping over said tab and capturing said bead within said elongated groove;

a pair of roller means each including a roller adapted to engage one of said trackways for supporting the framed panel in a top hung or bottom roller configuration, said roller means being adjustably positionable within said bracket housing; and a pair of guide means each adjustably positionable within said bracket housing for engaging one of said trackways and guiding said sliding door closure.

2. A kit as defined by claim 1 wherein said stile front wall includes a first curved portion integral with said side wall and an L-shaped, reverse bent portion integral with said first curved portion and having a free leg within said stile channel and extending towards said side wall.

3. A kit as defined by claim 2 wherein said housings of each of said brackets have an elongated slot in the top surface thereof, and wherein each of said guide means comprises an elongated body having a pair of spaced, resilient lugs extending perpendicular from a face thereof, each lug including a barb extending toward the lateral edge of said guide body, said lugs snapping through said housing slot to adjustably secure said guide means to said bracket.

4. A kit as defined by claim 3 wherein each of said guide bodies further includes a cantilevered tab extending from one end thereof, and at least one teat integral with the upper face of said cantilevered tab and engageable with said housing during adjustment of said guide means.

* * * * *